US009595181B2

(12) United States Patent
Katingari et al.

(10) Patent No.: US 9,595,181 B2
(45) Date of Patent: Mar. 14, 2017

(54) WEARABLE DEVICE ASSISTING SMART MEDIA APPLICATION AND VICE VERSA

(71) Applicant: Invensense, Inc., San Jose, CA (US)

(72) Inventors: Karthik Katingari, Milpitas, CA (US); Ardalan Heshmati, Saratoga, CA (US)

(73) Assignee: INVENSENSE, INC., San Jose, CA (US)

( * ) Notice: Subject to any disclaimer, the term of this patent is extended or adjusted under 35 U.S.C. 154(b) by 0 days.

(21) Appl. No.: 14/137,865

(22) Filed: Dec. 20, 2013

(65) Prior Publication Data

US 2015/0179050 A1 Jun. 25, 2015

(51) Int. Cl.
*G08B 1/08* (2006.01)
*G08B 25/10* (2006.01)

(52) U.S. Cl.
CPC ..... *G08B 25/10* (2013.01)

(58) Field of Classification Search
None
See application file for complete search history.

(56) References Cited

U.S. PATENT DOCUMENTS 7,725,532 B2 * 5/2010 Jeon ..... H04L 67/327 340/522
8,562,489 B2 * 10/2013 Burton et al. ..... 482/9
9,013,297 B1 * 4/2015 Dey ..... A42B 3/046 340/539.11
2002/0068600 A1 * 6/2002 Chihara et al. ..... 455/550
2002/0115478 A1 * 8/2002 Fujisawa et al. ..... 455/567
2005/0190065 A1 * 9/2005 Ronnholm ..... A61M 21/00 340/575
2007/0159926 A1 * 7/2007 Prstojevich et al. ..... 368/10
2008/0198005 A1 * 8/2008 Schulak ..... G08B 25/10 340/540
2008/0252445 A1 * 10/2008 Kolen ..... G08B 21/0446 340/539.16
2009/0261978 A1 * 10/2009 Lee ..... H04L 12/2803 340/573.1
2009/0270743 A1 * 10/2009 Dugan et al. ..... 600/500
2009/0303031 A1 * 12/2009 Strohallen ..... G08B 25/10 340/501
2009/0322513 A1 * 12/2009 Hwang ..... A61B 5/02055 340/539.12
2010/0095251 A1 * 4/2010 Dunko ..... H04M 1/72572 715/863
2010/0160744 A1 * 6/2010 Ha ..... H04W 4/02 600/301
2012/0044069 A1 * 2/2012 Saxena et al. ..... 340/539.12
2013/0106603 A1 * 5/2013 Weast ..... G06F 1/163 340/539.11
2013/0154838 A1 * 6/2013 Alameh ..... G04G 21/02 340/575

(Continued)

*Primary Examiner* — Curtis King
(74) *Attorney, Agent, or Firm* — Maryam Imam; IPxLaw Group LLP

(57) ABSTRACT

A system includes a wearable device connected to a user and a smart media in remote communication with the wearable device. The wearable device is operable to track movement of the user and transmit the track movement information to the smart media. The smart media is operable to receive the track movement information and to use the received track movement information in an independent application.

38 Claims, 8 Drawing Sheets

(56) References Cited

U.S. PATENT DOCUMENTS

| | | | | |
|---|---|---|---|---|
| 2014/0171146 | A1* | 6/2014 | Ma | H04M 1/72569 455/550.1 |
| 2015/0127298 | A1* | 5/2015 | Gangumalla | G01C 22/006 702/160 |
| 2015/0170504 | A1* | 6/2015 | Jooste | A61B 5/6898 340/539.12 |
| 2015/0177020 | A1* | 6/2015 | An | G01C 17/38 702/92 |
| 2015/0313542 | A1* | 11/2015 | Goldberg | A61B 5/0205 600/384 |
| 2016/0071392 | A1* | 3/2016 | Hankey | G08B 21/0453 340/573.1 |

* cited by examiner

WEARABLE DEVICE ASSISTING SMART MEDIA APPLICATION AND VICE VERSA

FIELD OF THE INVENTION

Various embodiments of the invention relate generally to a wearable device and particularly to the wearable device as used with a smart media.

BACKGROUND

Mobile devices are commonly used to determine a user's location and launch applications to help the user find desired locations. Health and fitness wearable devices are designed to track a user's activity and/or health-related attributes around the clock. Such activities and/or attributes include steps taken by the user using a pedometer, activity and context classification, heart rate, pace, calorie burn rate, etc. The wearable device monitors various vital information and reports them to the user. Typically, the user then uploads this information into a computer for various analysis. The same holds true in the case of mobile devices in that the information being reported to the user is often times utilized by the user for analysis or further determinations.

Upon receiving a report or displayed information, the user must manually manipulate or utilize the information. This is clearly limiting. Furthermore, using two independent monitoring devices does not allow for power consumption management.

There are currently systems that use a wearable device to communicate with a smart phone in transmitting information such as time, distance, and other similar user activities. However, the smart phone and the wearable device work independently of one another. This limits the type of information and usage of the system, among other disadvantages.

Therefore, what is needed is a system for improved monitoring of a user's activities while managing power consumption.

SUMMARY

Briefly, a system includes a wearable device connected to a user and a smart media in remote communication with the wearable device. The wearable device is operable to track movement of the user and transmit the track movement information to the smart media. The smart media is operable to receive the track movement information and to use the received track movement information to enable or enhance the functionality of an independent application running on the smart media Conversely, intelligence available in the smart media can be passed on to the wearable device to improve its operation.

A further understanding of the nature and the advantages of particular embodiments disclosed herein may be realized by reference of the remaining portions of the specification and the attached drawings.

DETAILED DESCRIPTION OF EMBODIMENTS

Figure 1:
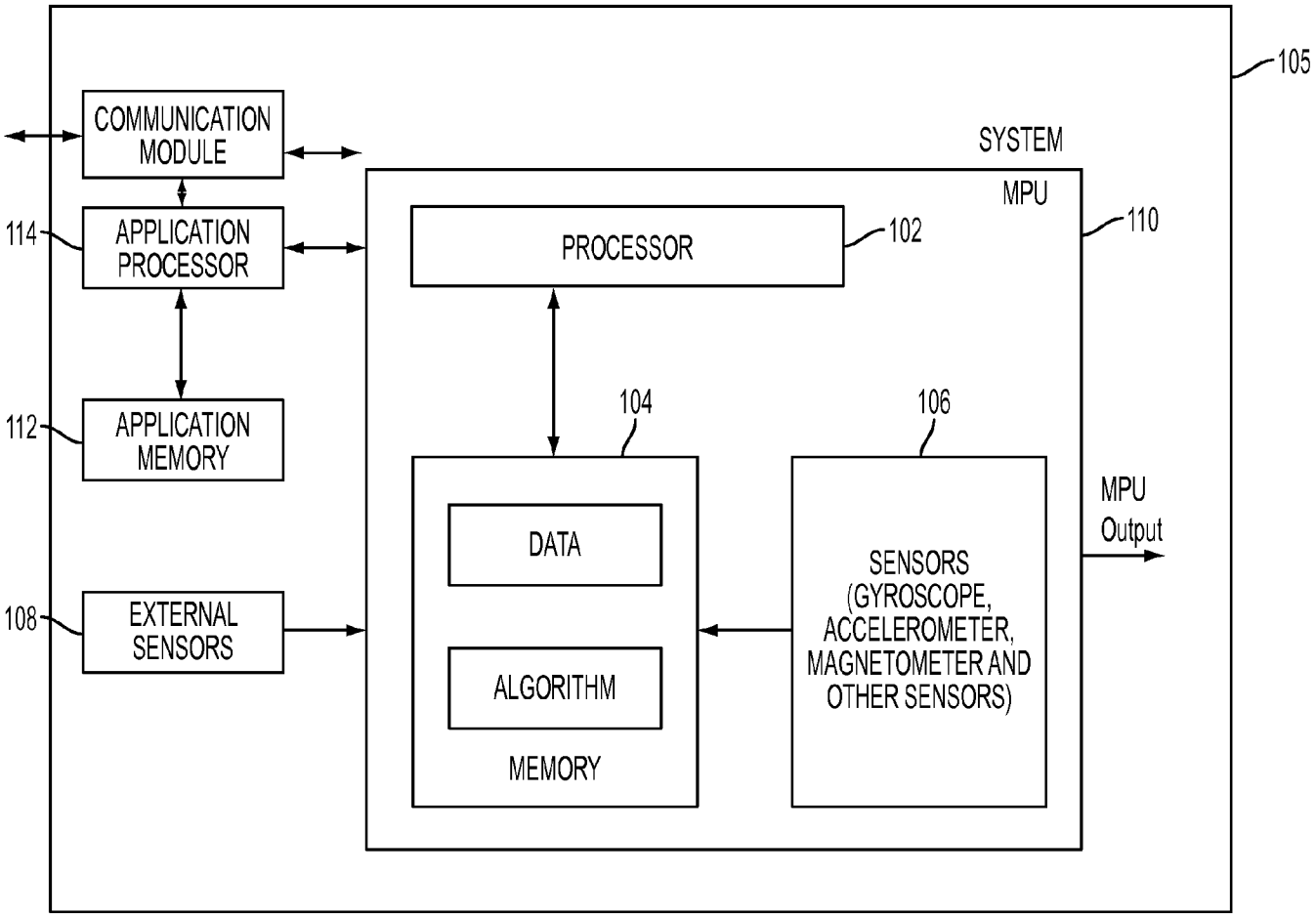
FIG. 1 shows a motion tracking system 105, in accordance with an embodiment of the invention.

In the described embodiments, a motion tracking device also referred to as Motion Processing Unit (MPU) includes at least one sensor in addition to electronic circuits. The sensors, such as the gyroscope, the magnetometer, the accelerometer, microphone, pressure sensors, proximity, ambient light sensor, among others known in the art, are contemplated. Some embodiments include accelerometer, gyroscope, and magnetometer, which each provide a measurement along three axes that are orthogonal relative to each other, referred to as a 9-axis device. Other embodiments may not include all the sensors or may provide measurements along one or more axis.

As used herein, the term smart media is intended to include computer-based devices, having sufficient communications capability, processing and capability to transmit and receive data, commands and information and communicate with multiple devices using one or more communication methods (i.e., WIFI, MIFI, 3G, 4G, Bluetooth, Bluetooth Low-Energy [BLE], and other communication protocols). A smart media may include any computer-based device as described above including, but not limited to, smart phones, Mobile Wi-Fi (MIFI) devices, computers, wearable computing devices, computing routers, computer-based network switches, and the like. It is to be appreciated that the smart media may be any computer such as a personal computer, microcomputer, workstation, hand-held device, smart media, smart router, smart phone, or the like, capable of communication over a communication method. It is envisioned that smart media will also include a user interface (UI) which will enable a user to more readily connect and configure all associated devices of the system.

As used herein, the term "remote device" is intended to include computer devices, non-computer devices and sensing devices that are i) capable of acquiring data in relation to a predetermined activity or performing a predetermined activity in relation to a received command, and ii) capable of communication at least uni-directionally, and preferably bi-directionally, over a communication link, with smart media across a common communication method (i.e., WIFI, MIFI, 3G, 4G, Bluetooth, Bluetooth Low-Energy [BLE], and other communication protocols). Typically, it is envisioned that a remote device though having limited, if any, computer-based functionality as compared to a traditional personal computer for instance, will have additional utility in combination with the invention. Examples of a remote device may include but not be limited to devices described herein that may take the form of certain wearable devices described above as well as televisions, garage doors, home alarms, gaming devices, toys, lights, gyroscope, pressure sensor, actuator-based devices, measurement-based devices, etc. The use of the descriptor "remote" does not require that the device be physically separate from a smart media or wearable device, rather that the control logic of the remote device is specific to the remote device. A remote device may or may not have a UI.

As used herein, the term "wearable device" is intended to include computer devices, non-computer devices and sensing devices that are: i) optionally capable of having an interaction with a user through a user interface (UI) associated with the device; ii) wearable by a user or may be carried, held or are otherwise transportable by a user iii) optionally with storage capability. Typically, it is envisioned that a wearable device though having limited computer-based functionality as compared to a traditional personal computer for instance, will have additional utility in combination with the invention. Examples of a wearable device may include but not be limited to devices described herein that may take the form of pedometers, chest straps, wrist bands, head bands, arm bands, belt, head wear, hats, glasses, watches, sneakers, clothing, pads, etc. In many implementations, a wearable device will be capable of converting a user's input of a gesture or movement into a command signal.

In the described embodiments, "raw data" refers to measurement outputs from the sensors which are not yet processed. "Motion data" refers to processed sensor data. Processing may include applying a sensor fusion algorithm or applying any other algorithm such as calculating confidence interval or assisting a wearable device or smart media. In the case of the sensor fusion algorithm, data from one or more sensors are combined to provide an orientation of the device. In an embodiment, orientation includes heading angle and/or confidence value. In the described embodiments, a MPU may include processors, memory, control logic and sensors among structures. In the described embodiments, predefined reference in world coordinates refers to a coordinate system where one axis of the coordinate system aligns with the earth's gravity, a second axis of the coordinate system coordinate points towards magnetic north and the third coordinate is orthogonal to the first and second coordinates.

FIG. 1 shows a motion tracking system 105, in accordance with an embodiment of the invention. The system 105 is shown to include a MPU 110, an application processor 114, an application memory 112, and external sensors 108. In an embodiment, MPU 110 includes processor 102, memory 104, and sensors 106. The memory 104 is shown to store algorithm, raw data and/or processed sensor data from the sensors 106 and/or the external sensors 108. In an embodiment, sensors 106 includes accelerometer, gyroscope, magnetometer, pressure sensor, microphone and other sensors. External sensors 108 may include accelerometer, gyroscope, magnetometer, pressure sensor, microphone, environmental sensor, proximity, haptic sensor, and ambient light sensor among others sensors.

In some embodiments, processor 102, memory 104 and sensors 106 are formed on different chips and in other embodiments processor 102, memory 104 and sensors 106 reside on the same chip. In yet other embodiments, a sensor fusion algorithm that is employed in calculating the orientation is performed external to the processor 102 and MPU 110. In still other embodiments, the sensor fusion and confidence interval is determined by MPU 110.

In an embodiment, the processor 102 executes code, according to the algorithm in the memory 104, to process the data in the memory 104. In another embodiment, the application processor sends to or retrieves from application memory 112 and is coupled to the processor 102. The processor 102 executes the algorithm in the memory 104 in accordance with the application in the processor 114. Examples of applications are as follows: a navigation system, compass accuracy, remote control, 3-dimensional camera, industrial automation, or any other motion tracking application. It is understood that this is not an exhaustive list of applications and that others are contemplated.

Figure 2A:
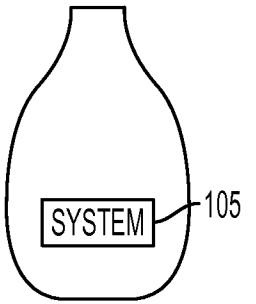
FIGS. 2(*a*) through 2(*c*) show exemplary applications of the system 105, in accordance with various embodiments of the invention.
Figure 2B:
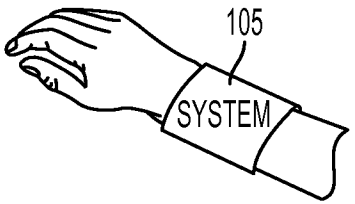
Figure 2C:
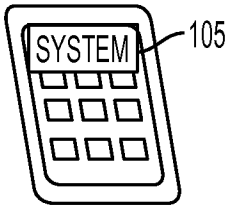

FIGS. 2(*a*) through 2(*c*) show exemplary applications of the system 105, in accordance with various embodiments of the invention. FIG. 2(*a*) shows a pedometer to include the system 105 for calculating pedometer step counting function. While not typically required for a pedometer device, the sensors available may also be used to determine the 3D orientation of that device and as an extension, the wearer.

Figure 3:
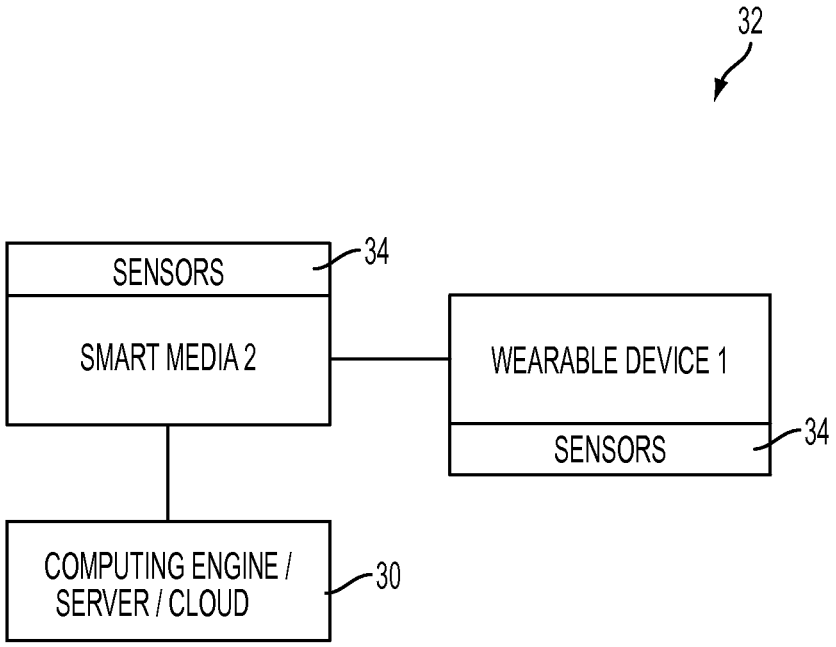
FIG. 3 shows a system 32, in accordance with an embodiment of the invention.

FIG. 2(*b*) shows a wearable sensor on a user's wrist with the wearable sensor including the system 105. In some embodiments, the wearable sensor can be worn on any part of the body. System 105 calculates the orientation of the wearable sensor. In FIG. 2(*c*), a smartphone/tablet is shown to include the system 105. The system 105 calculates the orientation, such as for global positioning applications, of the smartphone/tablet. An example of a sensor is provided in U.S. Pat. No. 8,250,921, issued on Aug. 28, 2012 by Nasiri et al., and entitled "Integrated Motion Processing Unit (MPU) With MEMS Inertial Sensing And Embedded Digital Electronics FIG. 3 shows a system 32, in accordance with an embodiment of the invention. The system 32 is shown to include a smart media 2, a wearable device 1, and a computing engine 30. The smart media 2 is shown to include sensors 34 and the wearable device is shown to include sensors 34. The sensors 34 of FIG. 3 are analogous to the sensors 106 of FIG. 1 and each of the smart media 2 and wearable device 2 is analogous to the system 105.

In accordance with an exemplary application of the system 32, the wearable device 1 is worn by the same user using the smart media 2, where the user is either carrying or is in close proximity to the smart media 2. In this manner, if the wearable device 1 detects a certain context, the same context is then also assumed to be true for the user of the smart media 2 and if the smart media 2 detects a certain context, the same context is then also assumed to be true for the user of the wearable device 1. An example of the distance allowing for the foregoing presumption regarding the context between the wearable device 1 and the smart media 2—close proximity—is within the same room or on the user. It is noted that this is merely an example of the distance between the wearable device and smart media and that other suitable measures of distance may be employed.

The smart media 2 and the wearable device 1 work together rather than independently thereby improving each of their respective operations by taking advantage of information available from the other.

The wearable device 1 can be any of the following: headband, glasses, watch, pen, pedometer, chest strap, wrist band, head arm band, head wear, hat, sneakers, belt, or clothing. It is understood that is not by any means an exhaustive list of examples of the wearable device 1.

In an embodiment of the invention, the wearable device 1 determines power management of the system 32 based on context information transmitted from the smart media 1.

Referring still to FIG. 3, the smart media 2 is shown coupled to the computing engine 30 and to the wearable device 1. The coupling of the smart media 2 to the wearable device 1 may be a physical connection or a remote connection, such as Bluetooth, Bluetooth low energy, or direct Wifi. The smart media 2 uses various protocols for communication, such as the Internet,—Wifi, or Bluetooth. The computing engine 30 may be one or more servers or in the Cloud. In some embodiments, the computing engine 30 is a part of the smart media 2 or a part of the wearable device 1. In some embodiments of the invention, the computing engine is located externally to the smart media 2 and the wearable device 1, such as shown in FIG. 3. The wearable device may include a database.

The wearable device 1 may be any device that a user has attached to a part of his/her body. Although by no means all inclusive, examples of such devices are provided in FIGS. 2(*a*)-2(*c*). The smart media 2 is a mobile device, such as but not limited to a smart media.

In operation, the wearable device 1 is typically connected to or travels with the user (not shown) as is the smart media 2 and the two are in remote communication. The wearable device 1 is operable to track the movement of the user and transmit the track movement information to the smart media 2. The smart media 2 is operable to receive the track movement information and to use the received track movement information in an independent application. That is, the application running on the smart media is not necessarily aware of the wearable device 1 and not dedicated thereto.

The computing engine 30 stores information in a data base or other storage media. Such stored information may be a collection of possible activities that the user may engage in or various possible maps. The computing engine 30 can be used to report a particular context based on the data provided by the smart media 1 and relayed information from the wearable device 1. The context information established can be shared with the wearable device 1 as well.

Figure 4:
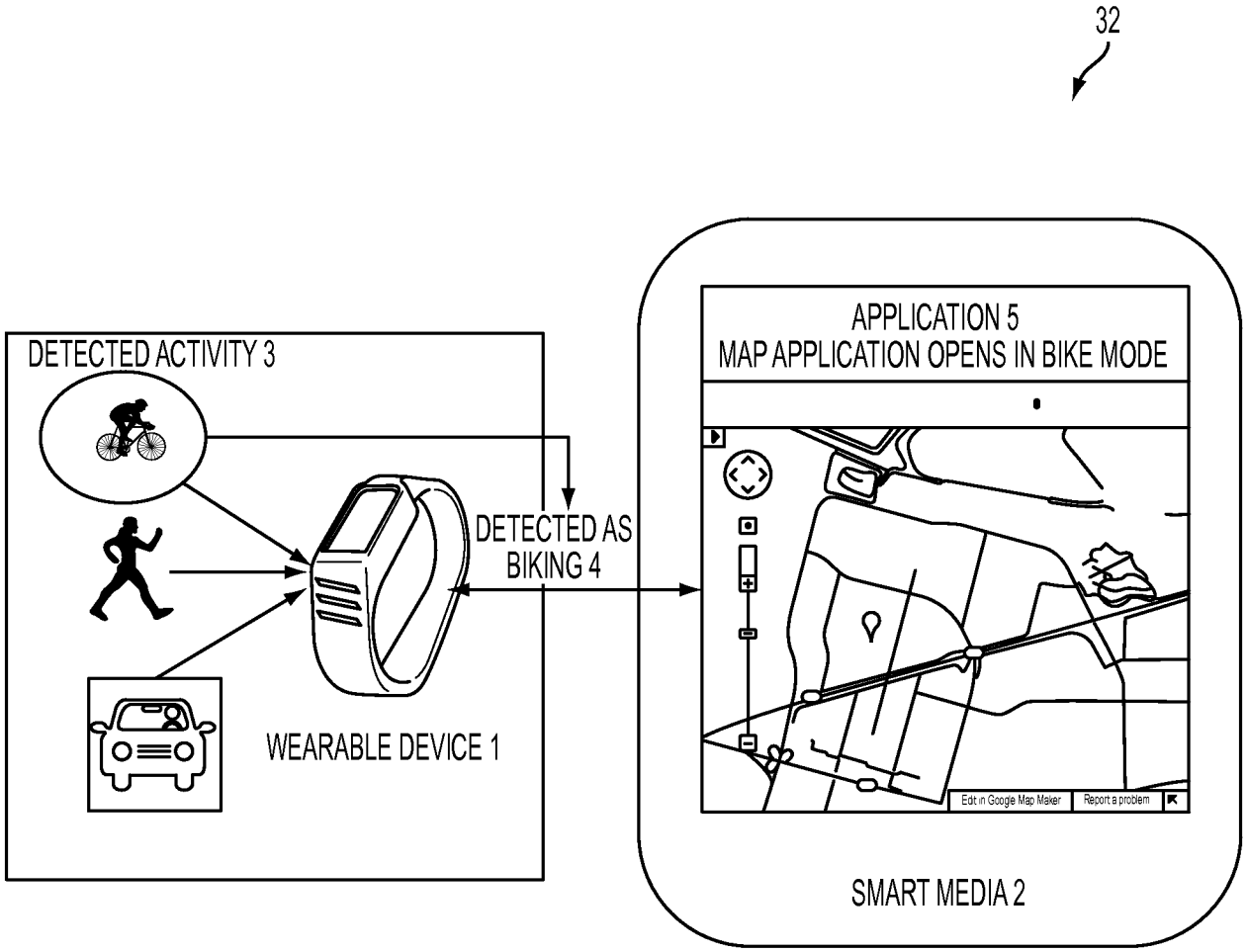
FIG. 4 shows the system 32 in an exemplary application, in accordance with an embodiment of the invention.

FIG. 4 shows the system 32 in an exemplary application, in accordance with an embodiment of the invention. In FIG. 4, the wearable device 1 establishes a context of an activity, such as a biking detection, as shown in the circle at 3, and reports the biking activity 4 to the smart media 2 as the detected activity. The smart media 2 then uses this information to have its application 5 to behave differently. For example, maps would open in biking mode rather than walking or driving mode. Also, the built-in location engine on the smart media 2 starts to enable global positioning system (GPS) in a timely manner and updates relevant to the biking speed rather than a driving, walking or stationary context. In this case, an example of updates is to change the frequency based on the activity, such as walking versus driving. Another update may be to change the resolution.

Figure 5:
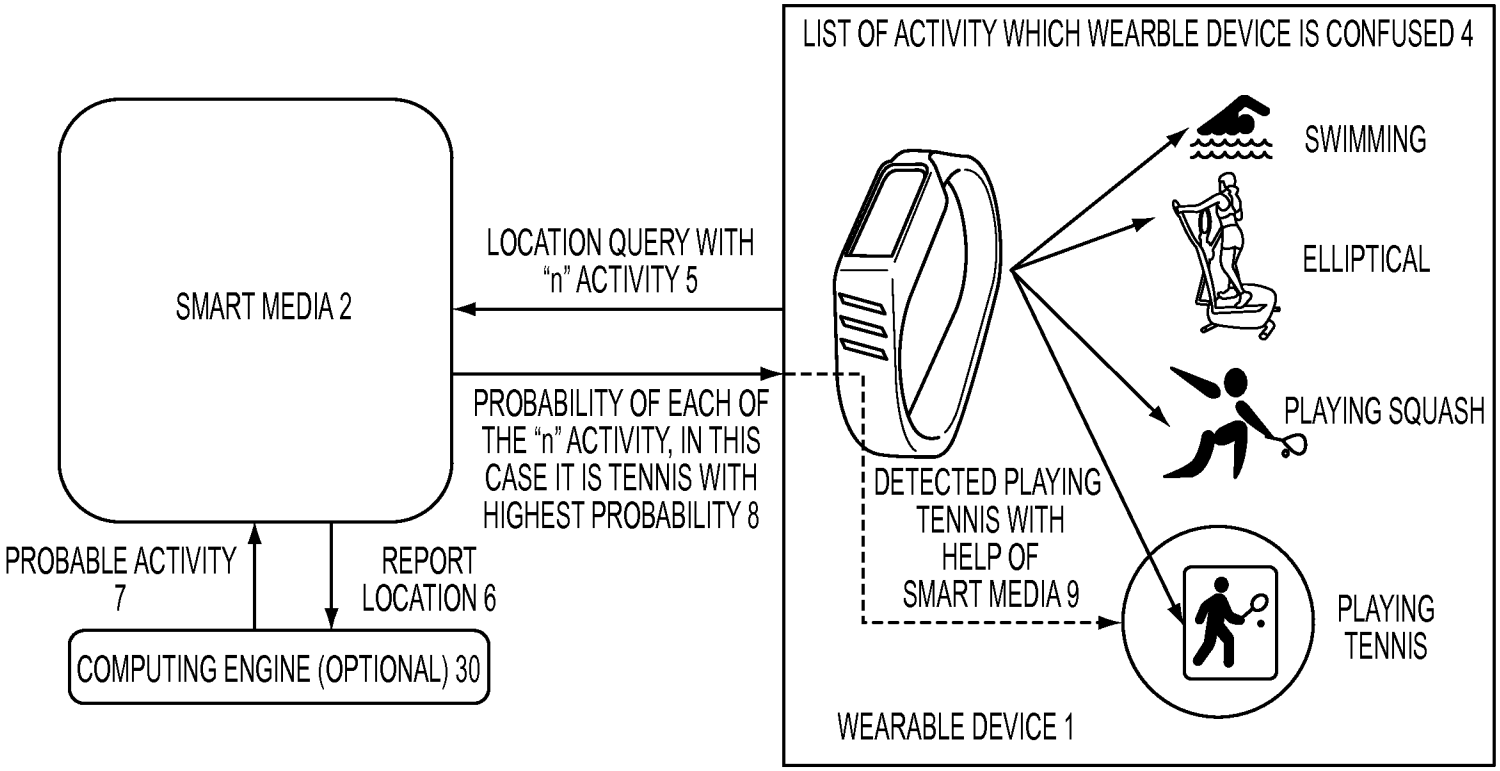
FIG. 5 shows a system 50 employing the smart media and the wearable device, in an alternate application, in accordance with yet another embodiment of the invention.

FIG. 5 shows a system 50 employing the smart media and the wearable device, in an alternate application, in accordance with yet another embodiment of the invention. The smart media 2 establishes a substantially accurate context of the activity. For example, the wearable device 1 might detect a swinging activity and is confused which activity exactly it is, shown at 4 in FIG. 5. It could have been Swimming, Elliptical, Squash or Tennis but the wearable device is unable to pin-point the exact activity. In this stage, wearable device 1 asks for help from the smart media 2 given the set of activity that confused it, shown at 5 in FIG. 5. Smart media 2 could either use its own built-in processing engine or optionally send the query out with location parameter(s), shown at 6, to the computing engine 3 which then computes the probability of the activity based on a known variety of detected user contexts, such as location, and returns with a possible activity probability at 7. This information is relayed back to the wearable device 1, shown at 8, which could then obtain the correct activity. In the case of FIG. 5, the location is close to a Tennis court, therefore, the activity most likely is Tennis, shown at 9.

Figure 6:
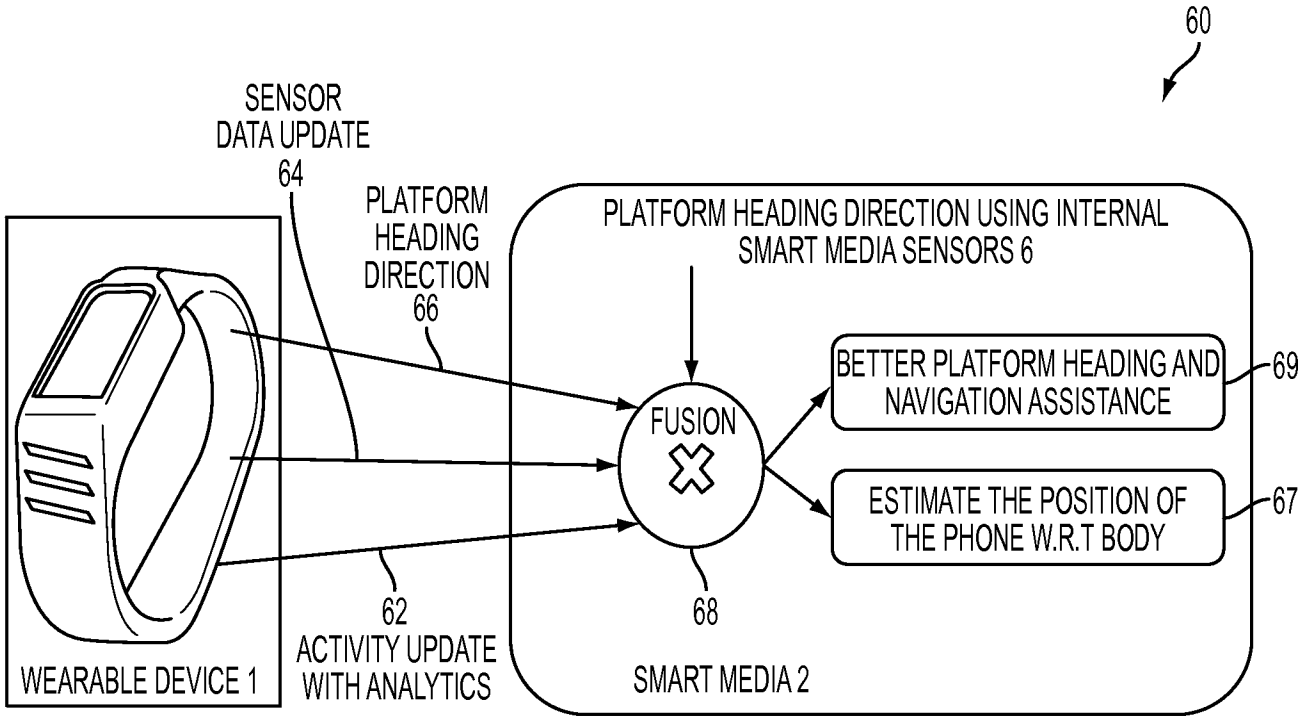
FIG. 6 shows a system 60 employing the wearable device, in accordance with another embodiment of the invention.

FIG. 6 shows a system 60 employing the wearable device, in accordance with another embodiment of the invention. In the system 60, the wearable device 1 assists the smart media 2 in determining the platform heading or navigation algorithm. In FIG. 6, the wearable device 1 provides information of platform heading direction 66, sensor data 64, activity type and relevant analytics like steps, and acceleration 62 to the smart media 2. The smart media 2 has internal sensors, such as the sensors 106, which calculate heading 6 as well. Combining or making a fusion, shown at 68, of the wearable device 1 platform heading direction 66, the sensor data (update) 64, the activity update with analytics 62 and the platform heading direction using the internal smart media sensors 6 provides better platform heading 69 and distance estimation. This also helps establish the context of the smart media with respect to the user (or user's body) 67 as in the hand or pocket based on the activity. The activity update 62 could also be used to trigger power saving modes. For example, if the user is stationary, the smart media 2 could use this information to turn off its motion engine for location updates.

Figure 7:
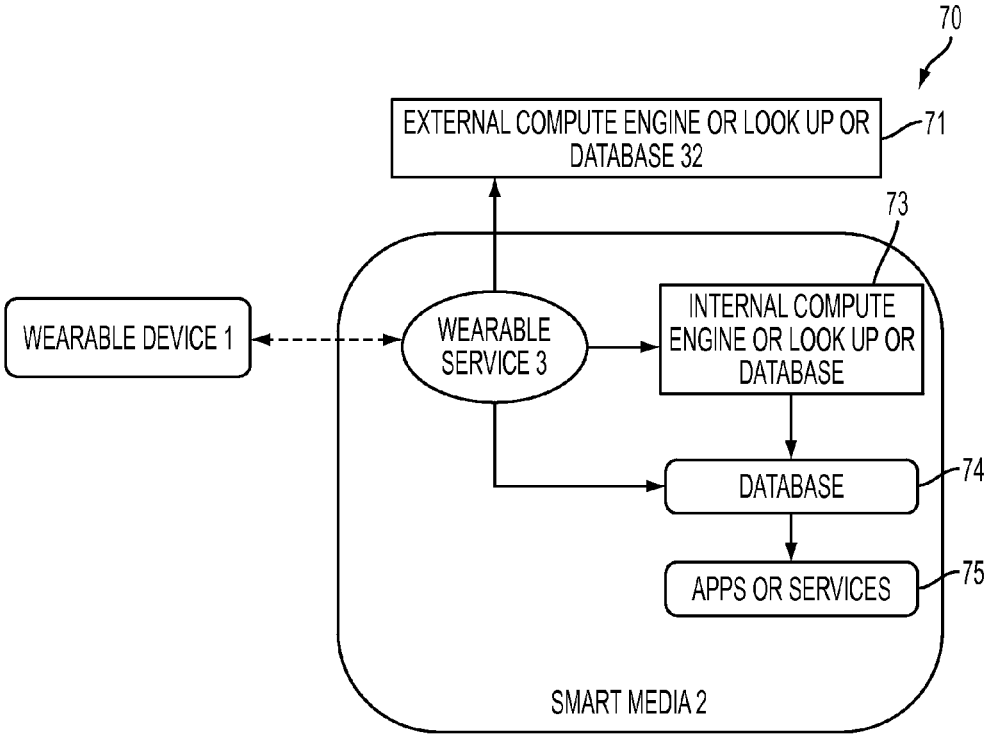
FIGS. 7-10 show flow charts of exemplary uses of the wearable device 1 in conjunction with the smart media 2, in accordance with various methods of the invention.

FIGS. 7-10 show flow charts of exemplary uses of the wearable device 1 in conjunction with the smart media 2, in accordance with various methods of the invention. FIG. 7 shows a flow chart 70 for using the wearable device 1 with the smart media 2 and the compute engine 30. In FIG. 7, the wearable device 1 is shown coupled to communicate with the smart media 2 and the smart media 2 is shown to communicate with the computing engine 71. The computing engine 71 is shown to be external relative to the smart media 2 and it could be, without limitation, to a look-up table or a database. The smart media 2 is shown to service the wearable device at 3 and updates or uses the database 74, located internally to the smart media 2, and/or uses an internal computing engine at 73, which may be a look-up table or a database. At 75, the smart media 2 launches or configures an application or service based on the output of the database at 74.

Figure 8:
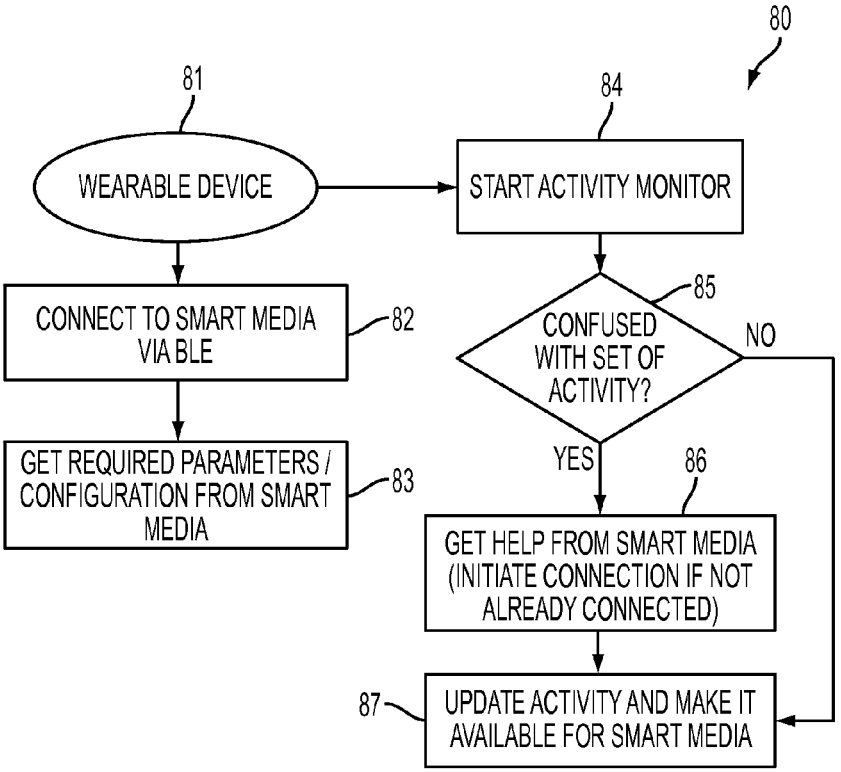

FIG. 8 shows a flow chart 80 of the steps performed by the wearable device 1 and the smart media 2 when the wearable device 1 is confused as to the activity being performed by the user, such as shown in the example of FIG. 5. In FIG. 8, at 81, the wearable device 1 starts to monitor an activity at 84 and connects to the smart media 2 via Bluetooth a 82 after which it obtains the required parameters and/or configuration for that particular activity from the smart media, at 83. Upon starting monitoring of the activity at 84, a determination is made as to whether or not the wearable device is confused at 85 and if so, it gets help from the smart media at 86 assuming it is connected to the smart media, otherwise, a connection is established prior to obtaining the smart media's help. If at 85, it is not confused with the activity, the process continues to 87.

Figure 9:
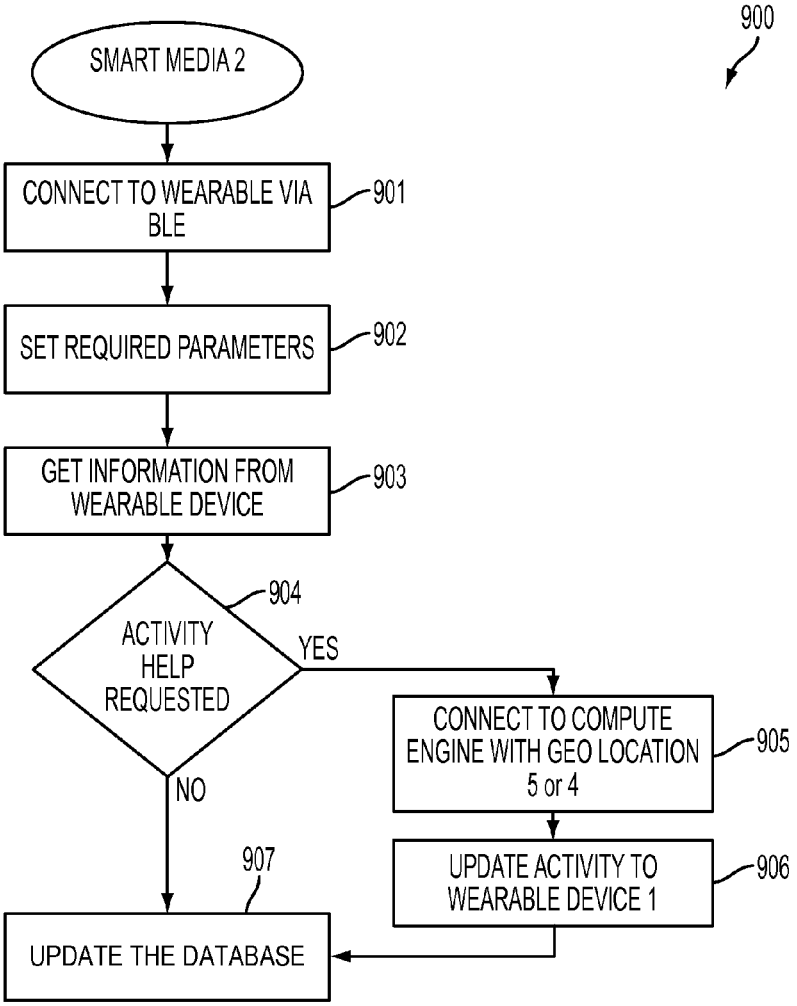

FIG. 9 shows a flow chart 900 of the steps performed by the smart media 2 in helping the wearable device 1 with an activity and/or updating the database in the smart media. At 901, the smart media 2 connects to the wearable device 1 through, for example, Bluetooth. At 902, the requisite parameters are set. Next, at 903, information from the wearable device 1 is obtained. Next, at 904, a request for activity help 904 is determined to be made or not, by the wearable device 1 and if the request has been made, at 905, the computing engine 30 is provided with the location of the wearable device 1, followed by, at 906, updating of the activity in the wearable device. Finally, at 907, updating of the database in the smart media is performed. If, at 904, no help is requested for the activity by the wearable device, the process goes to 907 to update the database.

Figure 10:
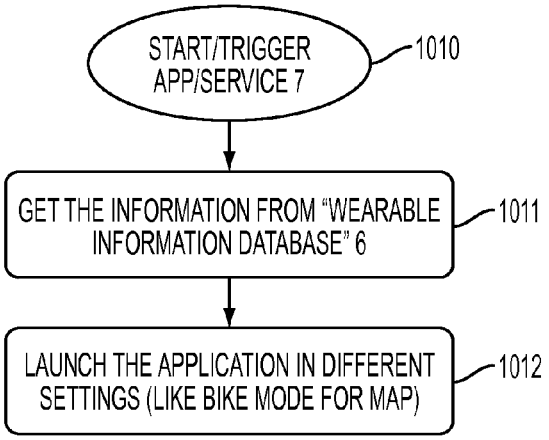

FIG. 10 shows a flow chart of the steps performed for starting a relevant application in the smart media based on the detected activity. At 1010, an application is started. Next, at 1011, information from the database of the wearable device 1 is obtained and at 1012, the relevant application is launched with different settings consistent with the activity of the user. For example, if the user is biking, the application is launched with the settings that launch a map for biking.

Although the description has been described with respect to particular embodiments thereof, these particular embodiments are merely illustrative, and not restrictive.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What we claim is:

1. A system comprising:

a wearable device connected to and operable and configurable by a user; and a smart media in remote communication with the wearable device, the wearable device being automatically and selectively operable to detect a certain context associated with the user or being unable to detect a certain context without assistance and further operable to transmit the same to the smart media, the smart media thereafter assuming the detected certain context to be accurate when the wearable device detects the certain context associated with the user and based on the certain context, the smart media being operable to execute a first application or when the wearable device is unable to detect the certain context associated with the user without assistance, the smart media being configured to determine the certain context associated with the user, based on information transmitted by the wearable device, the smart media further configured to transmit the identified certain context to the wearable device and upon the wearable device communicating the same to the smart media, the smart media thereafter assuming the detected certain context to be accurate, the wearable device through direct communication with the first application and through execution of the first application, being configured to communicate the certain context to the smart media and the smart media being operable to automatically access a second application related to the communicated certain context, wherein the smart media is operable to selectively detect the certain context based on remote communication between the smart media and the wearable device and an activity of the user, the wearable device assuming the detected and communicated certain context to be accurate and based on the detected and communicated certain context, the first application being operable to automatically access the second application, the second application being independent of the first application in that the second application is unaware of a presence of the wearable device.

2. The system of claim 1, wherein the smart media is a smartphone.

3. The system of claim 1, wherein the wearable device comprises any one of: a headband, glasses, watch, pen, pedometer, chest strap, wrist band, head arm band, head wear, hat, sneakers, belt, or clothing.

4. The system of claim 1, wherein the wearable device is operable to track health or fitness of the user.

5. The system of claim 1, wherein the wearable device communicates with the smart media through Bluetooth, Bluetooth low energy, or Wifi direct.

6. The system of claim 1, wherein the smart media has communication capability comprising: Internet, Wifi, or Bluetooth as well as location capability comprising: GPS, Wifi, or cellular-based location.

7. The system of claim 1, wherein the wearable device includes one or multiple sensors operable to sense track movement of the user.

8. The system of claim 7, wherein the sensor is any one of a gyroscope, a pressure sensor, an accelerometer, a magnetometer, temperature, humidity, force, heart rate, conductance, or a microphone.

9. The system of claim 1, wherein the smart media includes one or multiple sensors operable to sense track movement of the user and to synchronize with the wearable device.

10. The system of claim 9, wherein the sensor is a gyroscope, a pressure sensor, an accelerometer, a magnetometer, temperature, humidity, force, heart rate, conductance, or a microphone.

11. The system of claim 1, further including a computing engine operable to communicate with the wearable device and transmit the certain context thereto.

12. The system of claim 11, wherein the computing engine is a part of the smart media.

13. The system of claim 11, wherein the computing engine is a part of the wearable device.

14. The system of claim 11, wherein the computing engine is located externally to the wearable device and the smart media.

15. The system of claim 1, further including a computing engine operable to communicate with the smart media and transmit the certain context thereto.

16. The system of claim 1, wherein the wearable device is operable to determine one or more user activities.

17. The system of claim 16, wherein the smart media is responsive to the one or more possible user activities from the wearable device and, using the first application, is operable to select one of the one or more user activities based upon a location of the user.

18. The system of claim 16, wherein the selected one of the one or more user activities is transmitted to the wearable device.

19. The system of claim 18, wherein based on the selected one of the one or more user activities, the smart media is operable to adjust power consumption.

20. The system of claim 1, wherein the wearable device is operable to report the detected certain activity to the smart media, and the smart media, in response to the detected activity, is operable to adapt to the detected certain activity.

21. The system of claim 20, wherein the smart media is operable to update a global positioning system (GPS) using the second application and based on the detected certain activity.

22. The system of claim 20, wherein based on the detected certain activity, the smart media is operable to adjust power consumption.

23. The system of claim 1, wherein the smart media includes a sensor and the wearable device includes a sensor and using the sensor of the smart media and information from the sensors of the wearable device, the smart media is operable to combine platform heading direction provided by the sensor of the smart media and the information from the wearable device to provide a better platform heading.

24. The system of claim 1, wherein the smart media includes a sensor and the wearable device includes a sensor and using the sensor of the smart media and information from the sensor of the wearable device, the smart media is operable to combine platform heading direction provided by the sensor of the smart media and the information from the wearable device to provide a better distance estimation.

25. The system of claim 24, wherein the information includes platform heading direction, sensor data update, or activity update.

26. The system of claim 1, wherein the smart media is operable to set parameters for the wearable device.

27. The system of claim 26, wherein the parameters are calibration parameters, a sensor on/off parameter, setting a range parameter, and a sensitivity parameter.

28. The system of claim 1, wherein the wearable device and the smart media are in close proximity.

29. The system of claim 1, wherein the wearable device is operable to determine power management based on the detected certain context transmitted from the smart media.

30. The system of claim 1, wherein the second application is not dedicated to the wearable device.

31. The system of claim 1, wherein the smart media is operable to use the first application to detect an activity of the user and based on the detected activity, the smart media is further operable to launch the second application.

32. A method of monitoring activities of a user employing a wearable system comprising:

using a wearable device, connected to a user, automatically and selectively detecting a certain context associated with the user or failing to detect a certain context without assistance and communicating the same to the smart media, the smart media being in remote communication with the wearable device, the smart media thereafter assuming the detected certain context to be accurate when the wearable device detects the certain context associated with the user;

based on the certain context, the smart media executing a first application or when the wearable device is unable to detect the certain context associated with the user without assistance, the smart media determining the certain context associated with the user, the first application directly communicating with the wearable device;

based on the certain context, the smart media automatically accessing a second application related to the communicated certain context;

the smart media selectively detecting the certain context based on remote communication between the smart media and the wearable device and an activity of the user, the wearable device assuming the detected and communicated certain context to be accurate; and based on the detected and communicated certain context, the first application automatically accessing the second application, the second application being independent of the first application in that the second application is unaware of a presence of the wearable device.

33. The method of monitoring of claim 32, further including determining a location of the smart media and the wearable device with respect to a platform, the platform carrying the smart media and the wearable device.

34. The method of monitoring of claim 32, further including the wearable device determining a location of the smart media and the smart media determining a location of the wearable device.

35. The method of monitoring of claim 32, further including automatically launching the second application based on the certain context.

36. The method of monitoring of claim 35, further including receiving track movement information for use by the first application after launching the second application.

37. The method of monitoring of claim 32, wherein the second application is not dedicated to the wearable device.

38. The method of monitoring of claim 32, further including the smart media using the first application to detect an activity of the user and based on the detected activity, launching the second application.

* * * * *